United States Patent [19]

Mruk et al.

[11] Patent Number: 4,999,335

[45] Date of Patent: Mar. 12, 1991

[54] THERMAL DYE TRANSFER RECEIVING ELEMENT WITH BLENDED POLYETHYLENE/POLYPROPYLENE-COATED PAPER SUPPORT

[75] Inventors: William A. Mruk; Daniel J. Harrison, both of Rochester; Bruce C. Campbell, Webster, all of N.Y.

[73] Assignee: Eastman Kodak Company, Rochester, N.Y.

[21] Appl. No.: 449,630

[22] Filed: Dec. 11, 1989

[51] Int. Cl.[5] ..... B41M 5/035; B41M 5/26

[52] U.S. Cl. ..... 503/227; 8/471; 428/195; 428/207; 428/335; 428/336; 428/412; 428/513; 428/913; 428/914

[58] Field of Search ..... 8/471; 428/195, 207, 428/335, 336, 412, 513, 913, 914; 503/227

[56] References Cited

U.S. PATENT DOCUMENTS

| | | | |
|---|---|---|---|
| 4,748,150 | 5/1988 | Vanier et al. | 503/227 |
| 4,774,224 | 9/1988 | Campbell | 503/227 |
| 4,778,782 | 10/1988 | Ito et al. | 503/227 |
| 4,814,321 | 3/1989 | Campbell | 503/227 |

FOREIGN PATENT DOCUMENTS

| | | | |
|---|---|---|---|
| 2217866 | 11/1989 | United Kingdom | 503/227 |

*Primary Examiner*—Bruce H. Hess
*Attorney, Agent, or Firm*—Andrew J. Anderson

[57] ABSTRACT

A dye-receiving element for thermal dye transfer includes a blended polyethylene/polypropylene mixture extrusion-coated paper support having thereon a polymeric dye image-receiving layer.

20 Claims, No Drawings

THERMAL DYE TRANSFER RECEIVING ELEMENT WITH BLENDED POLYETHYLENE/POLYPROPYLENE-COATED PAPER SUPPORT

This invention relates to dye-receiving elements used in thermal dye transfer, and more particularly to the use of coated paper supports for such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals These signals are then transmitted to a thermal printer. To obtain the print, a cyan, magenta or yellow dye-donor element is placed face-to-face with a dye-receiving element. The two are then inserted between a thermal printing head and a platen roller. A line type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

U.S. Pat. No. 4,774,224 and U.S. Pat. No. 4,814,321 of Campbell and U.S. Pat. No. 4,748,150 of Vanier et al disclose dye-receiving elements for thermal dye transfer comprising polyethylene coated supports having thereon a polymeric dye image-receiving layer. As disclosed in U.S. Pat. No. 4,774,224, the polyethylene resin coating is applied to the support by an extrusion process in order to provide a smooth support which results in a more uniform surface appearance for thermally transferred images.

In order to obtain the beneficial result of uniform surface appearance, a sufficient amount of polyethylene must be used to obtain a smooth support surface. A problem exists, however, in that as the thickness of the extruded polyethylene layer is increased in order to provide a smoother surface, the printed density of the thermally transferred image is decreased.

U.S. Pat. No. 4,778,782 of Ito et al discloses dye-receiving elements having supports comprising synthetic paper laminated to a core material. As set forth in this patent, the synthetic paper may comprise a paper-like layer formed by stretching a pigmented polypropylene-polyethylene film mixture containing fillers in order to create microvoids. Microvoids are void regions around the fillers which are formed when bonds between the polymers and the fillers in the film are destroyed upon the film being stretched. It is also disclosed that such a paper-like layer containing microvoids may be provided directly on the surface of the core material. The stretching and lamination steps required to form such supports add to their manufacturing expense and complexity.

It would be desirable to economically provide a thermal dye transfer dye-receiving element which would minimize any density loss in transferred dye images while still providing a uniform surface appearance.

These and other objects are achieved in accordance with this invention which comprises a dye-receiving element for thermal dye transfer comprising a resin-coated paper support having thereon a polymeric dye image-receiving layer, wherein the resin coating comprises a blend of polyethylene and polypropylene substantially free of microvoids.

In accordance with this invention, it has been found that by blending polypropylene with polyethylene, a coating sufficiently thick to provide a smooth surface may be applied to a paper support while minimizing the density loss in thermally transferred dye images compared to polyethylene coatings without polypropylene. This beneficial result may be achieved when the blended mixture is simply extrusion coated onto the paper support, and does not require the complexity and expense of any stretching to create microvoids and lamination steps. The phrase "substantially free of microvoids" is intended to exclude films which have been intentionally stretched to create microvoids, but not to exclude unstretched films which may inherently possess some void areas.

The blended coating may be applied at any thickness which is effective to provide a smooth support surface. In general, good results have been obtained at thicknesses of from about 10 μm to about 100 μm, and the preferred thickness is from about 20 μm to about 50 μm. These thicknesses correspond to approximately from about 9 to about 90 $g/m^2$ and from about 18 to about 45 $g/m^2$, respectively.

The paper support itself may be made, for example, from a blend of soft and hardwood pulp in varying ratios. The thickness of the paper is not critical, and may be, for example, from 50 to 250 μm, preferably 100 to 200 μm. For this purpose, conventional photographic paper may be used.

The amount of polypropylene blended with the polyethylene may be any concentration which is effective for the intended purpose. In general, weight ratios of polyethylene to polypropylene of from about 4:1 to about 1:99 are considered effective, and the preferred ratios are from about 1:3 to about 1:20.

In a preferred embodiment of the invention, a white pigment, such as titanium dioxide, zinc oxide, barium sulfate, etc., is added to the blended coating in order to provide reflectivity.

In another preferred embodiment of the invention, a subbing layer is present between the coated support surface and the dye image-receiving layer. For example, a subbing layer may be used which is a vinylidene chloride copolymer as disclosed in U.S. Pat. No. 4,748,150 of Vanier et al. Other subbing layers found to be particularly effective for supports coated with polypropylene containing layers are the subject matter of copending, commonly assigned U.S. Ser. No. 07/449,631 of Henzel et al (now U.S. Pat. No. 4,965,241 relating to polymeric subbing layers having a silicon oxide backbone and aminofunctional substituents), U.S Ser. No. 07/449,661 of Henzel (now U.S. Pat. No. 4,965,239 relating to polymeric subbing layers having an inorganic backbone which is an oxide of titanium), and U.S. Ser. No. 07/449,628 of Henzel (now U.S. Pat. No. 4,965,238 relating to polymeric subbing layers having an inorganic backbone which is an oxide of zirconium), the disclosures of which are incorporated by reference.

The polymeric dye image-receiving layer of the dye-receiving element of the invention may comprise for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

In a preferred embodiment of the invention, the dye image-receiving layer is a polycarbonate. The term "polycarbonate" as used herein means a polyester of carbonic acid and a glycol or a dihydric phenol. Examples of such glycols or dihydric phenols are p-xylylene glycol, 2,2-bis(4-oxyphenyl)propane, bis(4-oxyphenyl)methane, 1,1-bis(4-oxyphenyl)ethane, 1,1-bis-(oxyphenyl)butane, 1,1-bis(oxyphenyl)cyclohexane, 2,2-bis(oxyphenyl)butane, etc.

In another preferred embodiment of the invention, the polycarbonate dye image-receiving layer is a bisphenol-A polycarbonate having a number average molecular weight of at least about 25,000. In still another preferred embodiment of the invention, the bisphenol-A polycarbonate comprises recurring units having the formula

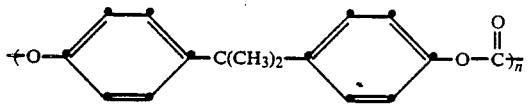

wherein n is from about 100 to about 500.

Examples of such polycarbonates include General Electric Lexan® Polycarbonate Resin #ML-4735 (Number average molecular weight app. 36,000), and Bayer AG Makrolon #5705® (Number average molecular weight app. 58,000). The later material has a $T_g$ of 150° C.

A dye-donor element that is used with the dye-receiving element of the invention comprises a support having thereon a dye layer. Any dye can be used in such a layer provided it is transferable to the dye image-receiving layer of the dye-receiving element of the invention by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R FS® (product of Mitsubishi Chemical Industries, Ltd.), and Kayalón Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.): basic dyes such as Sumicacryl Blue 6G® (product of Sumitomo Chemical Co., Ltd.), and Aizen Malachite Green® (product of Hodogaya Chemical Co., Ltd.);

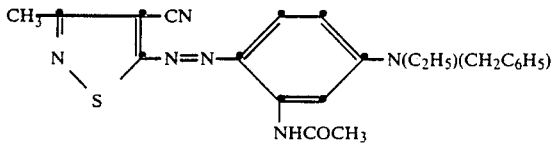

(magenta)

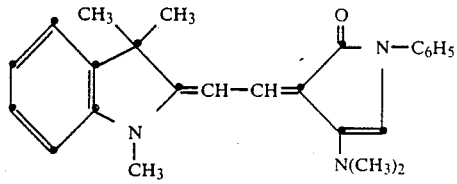

(yellow)

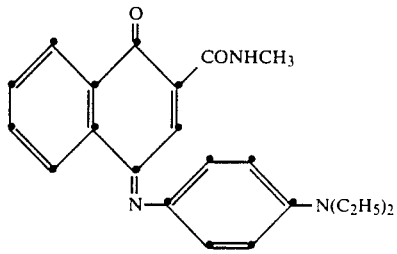

(cyan)

or any of the dyes disclosed in U.S. Pat. No. 4,541.830. the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene co acrylonitrile), a poly(sulfone) or a poly(phenylene oxide). The binder may be used at a coverage of from about 0 1 to about 5 g/m$^2$.

The dye layer of the dye-donor element may be coated on the support or printed thereon by a printing technique such as a gravure process.

Any material can be used as the support for the dye-donor element provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); poly-ethers such as polyoxymethylene; polyacetals; polyolefins such as polystyrene, polyethylene, polypropylene or methylpentane polymers; and polyimides such as polyimide amides and polyether imides. The support generally has a thickness of from about 2 to about 30 μm. It may also be coated with a subbing layer, if desired.

A dye barrier layer comprising a hydrophilic polymer may also be employed in the dye-donor element between its support and the dye layer which provides improved dye transfer densities. Such dye barrier layer materials include those described and claimed in U.S. Pat. No. 4,700,208 of Vanier et al, issued Oct. 13, 1987.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, phosphoric acid esters, silicone oils, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(styrene-co-acrylonitrile), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

As noted above, dye-donor elements are used to form a dye transfer image. Such a process comprises image-wise-heating a dye-donor element and transferring a dye image to a dye-receiving element as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements employed in the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dyereceiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE 1

Dye-receivers were prepared on a commercial paper stock of 5.2 mil (130 μm) thickness, 27 lb/1000 ft$^2$ (132 g/m$^2$) mixture of 20% hardwood, 80% softwood sulfite-bleached pulp. The stock was extrusion overcoated by methods well known in the art with a blend of 20% low density polyethylene (density 0.917), 75% crystalline polypropylene (density 0.917), and 4.4% Penn Ind. Chem.:Piccotex 120 (a copolymer of α-methyl styrene, m-vinyltoluene, and p-vinyltoluene), 0.3% 2,6-di-t-butyl-p-cresol, and 0.3% dilauryl thiodipropionate (see U.S. Pat. No. 3,652,725). This extruded layer was pigmented with 9 weight percent titanium dioxide.

Comparison coatings were prepared as above, but were extrusion overcoated (at the indicated coverage) with a blend of high and low density polyethylene (70:30), and pigmented with 9 weight percent titanium dioxide.

Each invention and comparison paper stock with the extrusion over:oat was then coated with a subbing layer of poly(acrylonitrile-co-vinylidene-co-acrylic acid) (14:79:7 weight ratio) (0.08 g/m$^2$) from 2-butanone. A dye-receiving layer of Bayer AG:Makrolon 5705 (a bis-phenol A polycarbonate) (5.6 g/m$^2$), diphenyl phthalate (0.63 g/m$^2$), and di-n-butyl phthalate (0.79 g/m$^2$) was coated from a dichloromethane-trichloroethylene solvent mixture. On top of this layer, an overcoat of a bisphenol-A polycarbonate modified with 50 mole % 3-oxa-1,5-pentanediol (0.5 g/m$^2$), Dow Corning:DC-510 Silicone Fluid (0.02 g/m$^2$) was coated from methylene chloride.

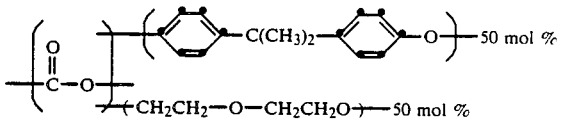

Overcoat polymer

A magenta dye-donor was prepared as follows. On one side of a 6 μm polyethylene terephthalate support a subbing layer of dupont Tyzor TBT (titanium tetra-n-butoxide) (0.12 g/m$^2$) was coated from a n-propyl acetate and 1-butanol solvent mixture. On top of this layer a layer of a mixture of two magenta dyes I and II shown below (0.19 g/m$^2$ and 0.09 g/m$^2$) in a cellulose acetate propionate binder (2.5% acetyl, 45% propionyl) (0.41 g/m$^2$) coated from a toluene, methanol, and cyclopentanone solvent mixture. Each dye layer also contained Shamrock Technologies, Inc.:S-363 (micronized blend of polyethylene, polypropylene, and oxidized polyethylene particles) (0.02 g/m$^2$).

On the reverse side of each dye-donor a backing (slipping) layer of Petrarch Systems:PS-513 (an amino-terminated polysiloxane) (0.006 g/m$^2$), p-toluenesulfonic acid (2.5% of the weight of the polysiloxane), Acheson Colloids:Emralon 329 (a dry film lubricant of polytetrafluoroethylene) (0.54 g/m$^2$), BYK Chemie USA:BYK-320 (a polyoxyalkylenemethylalkyl siloxane copolymer) (0.006 g/m$^2$) and Shamrock Technologies, Inc.:S-232 (micronized blend of polyethylene and carnauba wax particles) (0.02 g/m$^2$) was coated from a n-propyl acetate, toluene, isopropyl alcohol and n-butyl alcohol solvent mixture. The slipping layer had a subbing layer of dupont Tyzor TBT (0.12 g/m$^2$) coated from a 1-butanol and n-propyl acetate solvent mixture.

Magenta Dye (I)

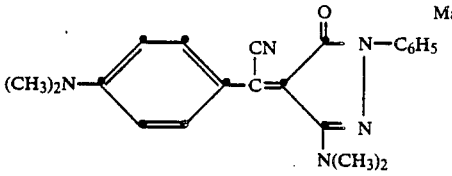

Magenta Dye (II)

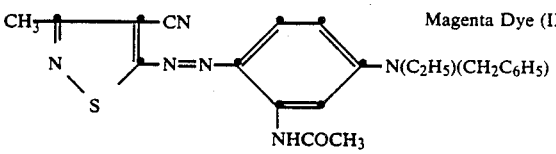

The dye-side of a dye-donor element strip approximately 10 cm × 13 cm in area was placed in contact with the polymeric dye image-receiving layer side of a dye-receiving element of the same area. This assemblage was clamped to a stepper-motor driven 60 mm diameter rubber roller. A TDK Thermal Head L-231 (thermostatted at 26° C.) was pressed with a force of 3.6 kg against the dye-donor element side of the contacted pair pushing it against the rubber roller.

The imaging electronics were activated causing the donor receiver assemblage to be drawn through the printing head/roller nip at 6.9 mm/sec. Coincidentally, the resistive elements in the thermal print head were pulsed for 29 μsec/pulse at 128 μsec intervals during the 33 msec/dot printing time. A stepped density image was generated by incrementally increasing the number of pulses/dot from 0 to 255. The voltage supplied to the printing head was approximately 23.5 volts, resulting in an instantaneous peak power of 1.3 watts/dot and maximum total energy of 9.6 mJoules/dot.

The maximum density of each stepped image was read to Status A green density and tabulated.

| Extruded Layer | | Dmax |
|---|---|---|
| Polyethylene/Polypropylene Blend (Invention) | (15. g/m$^2$) | 2.4 |
| Polyethylene/Polypropylene Blend (Invention) | (29. g/m$^2$) | 2.4 |
| Polyethylene/Polypropylene Blend (Invention) | (44. g/m$^2$) | 2.3 |
| Polyethylene (Comparison) | (15. g/m$^2$) | 2.3 |
| Polyethylene (Comparison) | (29. g/m$^2$) | 2.1 |
| Polyethylene (Comparison) | (44. g/m$^2$) | 1.8 |

The above results show that polyethylene/polypropylene coating blends minimize density loss in transferred images compared to polyethylene coatings as the coating extruded layer coverage is increased in order to obtain a smoother surface.

The invention has been described in detail with particular reference to preferred embodiments thereof, but it will be understood that variations and modifications can be effected within the spirit and scope of the invention.

What is claimed is:

1. In a dye-receiving element for thermal dye transfer comprising a resin-coated paper support having thereon a polymeric dye image-receiving layer, the improvement wherein the resin coating comprises a blend of polyethylene and polypropylene substantially free of microvoids.

2. The element of claim 1, wherein the weight ratio of polyethylene to polypropylene in the resin coating is in the range of from about 4:1 to about 1:99.

3. The element of claim 2, wherein the weight ratio is in the range of from about 1:3 to about 1:20.

4. The element of claim 1, wherein the resin coating is from about 10 μm to about 100 μm thick.

5. The element of claim 4, wherein the resin coating is from about 20 μm to about 50 μm thick.

6. The element of claim 1, wherein the dye image-receiving layer comprises a bisphenol-A polycarbonate having a number average molecular weight of at least about 25,000.

7. The element of claim 1, wherein a subbing layer is present between the resin-coated support and the dye image-receiving layer.

8. The element of claim 1, wherein the resin coating further comprises a white pigment.

9. In a process of forming a dye transfer image comprising imagewise-heating a dye-donor element comprising a support having thereon a dye-containing layer and thereby transferring a dye image to a dye-receiving element to form said dye transfer image, said dye-receiving element comprising a resin-coated paper support having thereon a polymeric dye image-receiving layer, the improvement wherein the resin coating on the paper support comprises a blend of polyethylene and polypropylene substantially free of microvoids.

10. The process of claim 9, wherein the weight ratio of polyethylene to polypropylene in the resin coating is in the range of from about 1:3 to about 1:20.

11. The process of claim 9, wherein the resin coating is from about 20 μm to about 50 μm thick.

12. The process of claim 9, wherein the dye image-receiving layer comprises a bisphenol-A polycarbonate having a number average molecular weight of at least about 25,000.

13. The process of claim 9, wherein a subbing layer is present between the resin-coated support and the dye image-receiving layer.

14. The process of claim 9, wherein the resin coating further comprises a white pigment.

15. In a thermal dye transfer assemblage comprising:

(a) a dye-donor element comprising a support having thereon a dye-containing layer, and (b) a dye-receiving element comprising a resin-coated paper support having thereon a polymeric dye image-receiving layer, said receiving element being in a superposed relationship with said dye-donor element so that said dye-containing layer is in contact with said dye image-receiving layer, the improvement wherein the resin coating on the paper support comprises a blend of polyethylene and polypropylene substantially free of microvoids.

16. The assemblage of claim 15, wherein the weight ratio of polyethylene to polypropylene in the resin coating is in the range of from about 1:3 to about 1:20.

17. The assemblage of claim 15, wherein the resin coating is from about 20 μm to about 50 μm thick.

18. The assemblage of claim 15, wherein the dye image-receiving layer comprises a bisphenol-A polycarbonate having a number average molecular weight of at least about 25,000.

19. The assemblage of claim 15, wherein a subbing layer is present between the resin-coated support and the dye image-receiving layer.

20. The assemblage of claim 15, wherein the resin coating further comprises a white pigment.

* * * * *